United States Patent [19]

Limare et al.

[11] 4,189,359

[45] Feb. 19, 1980

[54] PROCESS FOR THE ELECTRODEPOSITION OF FERRO-NICKEL ALLOYS

[75] Inventors: Armand Limare; Guy Plancqueel, both of Rambouillet, France

[73] Assignee: Societe Metallurgique le Nickel-SLN, Paris, France

[21] Appl. No.: 937,935

[22] Filed: Aug. 30, 1978

Related U.S. Application Data

[63] Continuation-in-part of Ser. No. 713,431, Aug. 11, 1976, abandoned.

[30] Foreign Application Priority Data

Aug. 13, 1975 [FR] France ..... 75 25177

[51] Int. Cl.[2] ..... C25D 3/56; C25D 17/10; C25D 17/12

[52] U.S. Cl. ..... 204/43 T; 204/286; 204/293; 204/294

[58] Field of Search ..... 204/43 T, 286, 293, 204/294

[56] References Cited

U.S. PATENT DOCUMENTS

| | | | |
|---|---|---|---|
| 2,304,059 | 12/1942 | Bieber et al. | 204/293 |
| 3,804,726 | 4/1974 | Passal | 204/43 T |
| 3,806,429 | 4/1974 | Clauss et al. | 204/41 |

FOREIGN PATENT DOCUMENTS

| | | | |
|---|---|---|---|
| 938897 | 10/1948 | France | 264/13 |

OTHER PUBLICATIONS

C. T. Thomas et al., Trans. American Electro-Chem. Soc., vol. 45, pp. 193-218, (1924).

Abner Brenner, "Electrodeposition of Alloys", vol. I, pp. 59-63, (1963).

R. J. Claus et al., Plating, pp. 803-810, Aug. 1973.

*Primary Examiner*—G. L. Kaplan

*Attorney, Agent, or Firm*—Fleit & Jacobson

[57] ABSTRACT

A process of electrodepositing a layer of ferro-nickel alloy using a soluble anode consisting of anodic baskets filled with ferro-nickel shot of a composition substantially identical to that of the layer which it is desired to deposit.

29 Claims, No Drawings

PROCESS FOR THE ELECTRODEPOSITION OF FERRO-NICKEL ALLOYS

This is a continuation-in-part of U.S. Pat. Application Ser. No. 713,431, filed Aug. 11, 1976 and now abandoned.

The invention relates to a new process for the electrodeposition of ferro-nickel alloys, and is particularly concerned with the use of soluble anodes of ferro-nickel.

Until recent years, nickel-plating consisted solely of covering the pieces with a layer of pure nickel. New techniques have very recently appeared in the nickel-plating industry in which the nickel is partially replaced by iron. Ferro-nickel alloys of an iron content of up to 40% may be deposited, whereby the replacement of an expensive metal, nickel, by a considerably cheaper metal allows the net cost of nickel plating to be reduced quite sharply. These processes, which are described in U.S. Pat. Nos. 3,759,591, 3,806,429 and 3,812,566, and in French Pat. No. 2,226,479, aim essentially at replacing the soluble nickel anode of the conventional process by two anodes respectively made of iron and nickel. However, the use of two different anodic materials causes a large number of disadvantages; these include the problems of storage and of handling whilst renewing the anodes and the difficulty of finding a commercial material suitable for electroplating.

Moreover, it has been thought that materials used for this process should be products of high purity, such as, for example, of ARMCO iron with less than 0.15% impurities and of electrolytic nickel. It has been found, for example, that the presence of carbon can be troublesome in the nickel anode.

In order to form uniform plated layers it is necessary that the composition of the bath and especially the iron/nickel ratio should not vary during the electrolytic deposition of the alloy layer.

The difference in the oxidation potentials of iron and nickel causes numerous difficulties relating to the iron/-nickel ratio in the electrolyte. In order for this ratio to remain constant, the ratio of the respective anodic surfaces of the two metals should be kept constant since a slight alteration in the anodic surface of the iron can change the composition of the bath quite significantly because of the greater speed of dissolution of iron relative to nickel. When the electroplating apparatus ceases operation, the iron anode is covered by a layer of nickel which can reach or even exceed a thickness of 1 mm, thus causing a considerable variation in the iron/nickel ratio of the electrolyte. All this causes a lack of flexibility in the electroplating apparatus and requires a greater supervision thereof.

One of the objects of the invention is therefore to simplify the process of deposition of iron-nickel alloys.

Another object of the invention is to provide a nickel-plating process which can be stopped without difficulty and without this causing variations in the composition of the bath.

A further object of the present invention is to provide a process of the type mentioned above in which an electrolytic coating of high quality is obtained.

These and other objects, which will become apparent from the following description, are attained, according to the invention, by a process of electrolytically depositing a layer of a ferro-nickel alloy which comprises using as a soluble anode an anodic basket filled with ferro-nickel shot of a composition substantially identical to that of the layer which it is desired to deposit. The expression "substantially identical" indicates that only the iron/nickel ratio is important and that the presence of a certain number of impurities in the ferro-nickel starting material can be tolerated since the impurities are not generally found in the layer of alloy which is deposited on the cathode. These impurities either remain dissolved in the bath or are precipitated in the electrolysis tank in the form of a sediment.

The expression "substantially identical" also means that there are only small variations between the nickel content of the initial ferro-nickel, disregarding the impurities, and the nickel content of the plated deposit. These variations are generally within the limits of analysis error (0.5% by weight absolute error).

This possibility of tolerating a relatively increased amount of impurities by using ferro-nickel in place of nickel and iron is one of the more surprising and interesting features of the process. The amount of impurities which can be tolerated clearly varies with the nature of the impurities. In general, the impurities, which, like silicon, are precipitated as a sediment at the bottom of the electrolysis tank or of anodic cells provided for that purpose, are much more tolerable than those which are soluble in the electrolyte. Of the latter sort, however, cobalt, the amount of which can reach several percent (by weight), should be considered separately since it cannot easily be considered as an "impurity". It is deposited on the cathode at the same time as the iron and nickel and does not in any way harm the quality of the plated deposit, and therefore should not really be considered as an impurity.

It must be added that it is the appreciation of this tolerance of impurities which has allowed us to use ferro-nickel in electroplating.

This possibility has already been considered in the patents listed above as a poor alternative to the use of several anodes of pure metal, but, to the inventors' knowledge, no experimentation thereon has been performed. This should be explained by the absence of commercially available ferro-nickel of a purity equivalent to that of electrolytic nickel and in a form suitable for electroplating. It seemed useless to seek for granulating adjuvants, since such adjuvants added during the granulating operation became the impurities in the electro-deposition operation.

Thus the process of the invention, in providing a new technique for the use of ferro-nickel in electroplating, is a significant technical advance in the nickel-plating industry, the economic effects of which could be considerable.

This advance could only have been brought about by showing that the commonly held opinion regarding the purity of the materials intended for electroplating has not been completely justified in the case of ferro-nickel.

It is, however, clear that, despite this tolerance, it is more practical to work with materials which are as pure as possible.

The ferro-nickel shot is made by pouring the molten metal into a bath of water, and in order that the shot produced should have a suitable shape it is necessary to select granulating adjuvants for this type of alloy. On this subject reference is made to the patent application of Guy Plancqueal and Imre Toth, Serial No. 713,432, now abandoned, entitled "Process for Making Ferro-Nickel Shot for Electroplating," which was filed concurrently with said parent application (Ser. No.

713,431). The first granulating adjuvants tried were aluminum and magnesium; however, the use of the shot thus obtained was not completely satisfactory in that the appearance of a very appreciable quantity of sediment in the anodic cells was noted. A more detailed study has shown that the shot obtained from the baths enriched with aluminum and magnesium had a granular microstructure. At the time of the anodic dissolution, a significant proportion of these grains is broken down to form a sediment of a composition similar to that of the initial ferro-nickel. Further research has shown that the quantities and mixtures are critical since there is synergistic effect between different adjuvants.

One can determine in advance if a batch of shot will give a significant amount of sediment with the aid of a simple hand-vise test. This test consists of evaluating the crushing resistance of shot sample from the batch that it is desired to use by clamping the shot sample in a hand vise. If the shot sample is only slightly deformed, remains whole, and behaves like a ductile metal, then the batch of shot will give very little sediment. On the other hand, if the shot sample is deformed with crumbling, thus behaving like a brittle metal, the amount of sediment will be high unless the operating conditions are modified (for example, by using a high current density). A shot submitted to this hand-vise test which does not disintegrate when its larger diameter is decreased by ⅓ presents a sediment rate of less than 1.5%. It may also be mentioned that the hand-vise test performed by an average person corresponds to a compression test (referred to hereinafter) of from 2 to 2.5 tons.

The above-mentioned difficulties can be largely avoided by adjusting the operating conditions and especially the current density. However, according to a preferred method of operation of the process, these difficulties can be almost entirely eliminated by using the shot obtained from a metallic bath to which has been added a granulating adjuvant containing silicon and/or carbon. The maximum amount of the added adjuvants should be under 1% and preferably under 0.5%. The sum of the adjuvants must be higher than 0.1% and preferably higher than 0.15%, the best range being from 0.20 to 0.30%. The silicon is preferably introduced into the bath as ferro-silicon. The selection of the amount of silicon in the bath is extremely delicate; indeed, two requirements act in contrary directions: thus, to avoid the formation of a sediment caused by silicon, it is necessary to limit as far as possible the amount of silicon, but, to improve the shape of the shot, it is necessary to increase it. It is, therefore, preferred to keep the amount of silicon in the shot between 0.1 to 0.5% by weight.

In general, the ferro-nickel shot has the following composition:

| Material | Wt % |
|---|---|
| Nickel | 20–90 |
| Adjuvants: | <1 |
| Cobalt | |
| Silicon | |
| Manganese | |
| Magnesium | |
| Aluminum | |
| Carbon | |
| Other impurities | <0.2 |
| Copper | |
| Oxygen | |
| Sulfur | |

-continued

| Material | Wt % |
|---|---|
| Iron | Balance. |

Preferably, the granulometry of the shot used for the process according to this invention should comply with the following conditions: at least 90% (in weight) of the shot being smaller than 25 mm. and at least 90% being larger than 5 mm.

To be suitable for electroplating, the shot structure should be either columnar or equiaxed without dendritic sub-structures due to inter-dendritic segregation; the grain boundary must be fine. The columnar structure is preferred. Its grain size (largest dimension) preferably ranges between 1 and 15 mm. These structural data are well consistent with the aforementioned hand-vise test, and, if the shot complies with it, the structure is sufficiently dendriteless. For a definition of columnar and equiaxed structures, reference is made to Metals Handbook, 8th Edition, Volume 8, Mettallography, Structures and Phase Diagrams, published by the American Society for Metals, Metals Park, Ohio, page 144, and to A Concise Encyclopedia of Metallurgy by A. D. Merriman, Elsevier Publishing Company, Amsterdam, 1965, page 121.

The best way to differentiate the shot of the present invention from other marketed ferro-nickels of the prior art is to describe its structure. It seems now that to be suited for electroplating, as noted above, the structure of the ferro-nickel used must comply with the conditions described above, and no presently-marketed ferro-nickel to the inventors' knowledge complies with them.

To reveal the structure of a shot, Aqua Regia (ASTM E 407-70 N° 12) may be used. To reveal the sub-structures of the shot grains, the following reagent may be used:

400 ml HCl (density=1.2)
8 g $CuCl_2$
28 g $FeCl_3$
20 ml $HNO_3$ (density=1.4)
800 ml methanol
400 ml $H_2O$ This reagent is disclosed in the aforementioned A.S.M. Metals Handbook, Volume 7, in the Appendix.

A new test has been found which utilizes a compression device. If the shot is not disintegrated under a load of 5 tons, the sediment ratio will be under 1%, and, if the first fissuration appears at a value higher than 2 tons, the sediment ratio will be lower than 0.5%.

In carrying out this new compression test, a compression machine, e.g., INSTRON Model T.T.D.M. (as disclosed in Catalogue 1-1, entitled "Instron Machines et Materiel Modernes" d'essai des materiaux, published by Instron Limited, Halifax Road, High Wycombe, Bucks, England, pages 1–14) operating, for example, at a speed of about 5 mm/minute, and using a load, as for example, ranging from 0 to 10000 kg (0–10 metric tons), is employed to compress the shot sample, preferably of a size ranging between 10 and 15 mm.

The shot is compressed following the largest diameter direction. Two parallel flat areas of about 15 $mm^2$ are made by abrasion so that the stability of the shot between the two plates is ensured. The load is applied on the upper plate.

The above-described test allows one to obtain the shot deformation value $\Delta e$ ("e" for "epaisseur", i.e., thickness) as a function of the applied load in the form of a diagram. It also enables one to measure the load necessary for splitting and the load necessary for the appearance of the first fissuration.

This test is a very reliable way to predict the sediment ratio.

This test, specifically applied to the shot produced in certain of the examples, forms the subject matter of Example 37 described hereinafter.

To obtain a good shot, such as that described above, and using, as an example, a compression value of 0.5 metric ton on a shot complying with the afore-described structural conditions, at least silicon and two other adjuvants should be added to the afore-described granulating process in the following ranges, the ranges being given with an inaccuracy of 0.01%, and the range of the sums being given with an inaccuracy of 0.02%:

To obtain a sediment ratio of less than 1%:

Si=0.02 to 0.5%
C=0.03 to 0.2%
Mg=0.02 to 0.4%
Mn=0.01 to 0.1%
Al=0.01 to 0.1%

The sum of all the adjuvants added should be between 0.1 and 1.0%. The lower limit should be 0.2% when the ratio Ni/Fe+Ni is between 50 and 70%. The sum of Mg, Mn, and Al should be at least equal to 0.05%.

To obtain a sediment ratio of less than 0.5%:

Si=0.04 to 0.2%
C=0.03 to 0.1%
Mg=0.04 to 0.1%
Mn=0.02 to 0.1%
Al=0.01 to 0.06%

The sum of all the adjuvants added should be between 0.2 and 0.3%. The sum of Mg, Mn, and Al should be between 0.007 and 0.2%. This upper limit is essentially due to the fact that it is necessary to avoid pollution of the bath by the aforementioned metals.

In the case of ferro-nickels containing from 70% to 80% of nickel, the best ranges are:

Si=0.04 to 0.10%
C=0.03 to 0.05%
Mg=0.05 to 0.08%
Mn=traces
Al=traces

In the case of ferro-nickels containing from 50% to 69% of nickel, the best ranges are:

Si=0.1 to 0.2%
C=0.03 to 0.1%
Mg=0.03 to 0.08%
Mn=0.01 to 0.07%
Al=0.02 to 0.06%

The total amount of adjuvants should be under 1%, and preferably under 0.5%. The sum of the adjuvants must be higher than 0.1%, and preferably higher than 0.15%, the best range being from 0.20 to 0.30%.

The amounts of the other impurities present should, preferably, be under 0.20% in totality. More specifically, the amount of copper should be less than 0.03%, the amount of oxygen is preferably under 0.03%, and the amount of sulphur is under 0.02%.

The process thus described has, among other advantages, ease of operation due to replacement of two materials by one and the use of shot.

The use of ferro-nickel shot ensures, moreover, a constant and uniform dissolution of the two metals (nickel and iron) with a Faraday anodic yield near to unity, which facilitates the control and maintenance of the iron-nickel ratio in the electrolyte and ensures a good versatility of operation in allowing stopping of the process without major difficulties. The dissolution of the alloy is complete and does not cause formation of a large amount of sediment. The ratio of nickel to nickel plus iron in the shot ranges from about 20 to 90%, preferably from 40 to 80% .

The quality of the metal coating obtained by electrodeposition depends greatly on the ratio of ferric iron to the total amount of iron in the electrolyte. If this ratio is too high, the coating will contain ferric hydroxide, which appears as numerous specks of rust color. Thus, when the iron stabilizer is a complexing agent (as shown in the examples) this ferric iron ratio should not be more than 40%, and is preferably less than 20%.

It has been difficult to keep the ratio within the above limits, and, conventionally, such ratios are often near 50%. The process, according to the invention, presents a solution to this problem. The simple fact of using shot of ferro-nickel permits one to obtain a ratio of ferric iron in the solution within the above preferred limits, and, in many measurements of the ratio of ferric iron, none has exceeded 20%.

Another factor influencing the quality of the cathodic coating is the cleanliness and the porosity of the anodic bags (sacs) surrounding the anodes which retain the sediment that otherwise would fall to the foot of the electrolytic tank. if these anodic cells are not changed frequently, the cathodic coating may have a very irregular thickness. This problem is particularly acute when small quantities of sulphur are added to the nickel anodes to facilitate dissolution. The present invention also presents a solution to this problem since, when using ferro-nickel shot, the anodic cells retain satisfactory porosity and cleanliness, and excellent cathodic coatings can be obtained without the necessity to change the anodic cells frequently.

Finally, the ferro-nickel shot are very soluble, and this high solubility avoids the necessity for using solubilizing agents and enables the quantity of chloride ions in the bath to be reduced to between 10 to 40 g/l and/or the ratio between sulfate and chloride concentration (in g/l) to reach 2.5 and even 4.

It is interesting to note that none of the advantages described above are mentioned in the patents which allude to the possibility of using ferro-nickel. This, whatever its explanation, shows well the surprising results of the use of ferro-nickel in the form of shot.

The invention will now be illustrated by the following examples in which all percentages are by weight.

EXAMPLE 1

Ferro-nickel shot containing 77% of nickel, called herein "FN 77", were prepared from a molten bath enriched with aluminum and magnesium, as described in Example 1 of the aforementioned patent application, Ser. No. 713,432.

The chemical analysis was as follows:

Ni=77.2%
Fe=21.9%
Co=0.38%
Si=0.008%
Mn=0.007%
Mg=0.0002%
Al=0.004%
C=<0.002%

Solubility tests were carried out in a 12-liter tank in a bath of the following composition:

$NiSO_4 \cdot 6H_2O = 75$ g/l
$NiCl_2 \cdot 6H_2O = 75$ g/l
$FeSO_4 \cdot 7H_2O = 10$ g/l
$H_3BO_3 = 45$ g/l Commercial products of the Udylite Company:

| | | | |
|---|---|---|---|
| Brighteners | FN 1 | = 25 | cc/liter |
| | FN 2 | = 2.5 | cc/liter |
| | B 84 | = 18 | cc/liter |
| Stabilizer | NF | = 25 | g/liter |
| Wetting Agent | 62A | = 1 | cc/liter |

The operating conditions were:

- anodic current density 10 Amps/dm$^2$
- total anodic surface 3.8 dm$^2$
- pH = 3.7
- length of test = 235 hours (corresponding to a quantity of current of 8694 Amp-hours).

The results obtained were as follows: After 83 hours of operation, i.e., a current amount of 3082 Amphours, a residue remained in the baskets consisting of metallic grains, the quantity of which corresponded to 4.4% of the weight of shot consumed. Chemical analysis of the residue showed that the latter was composed of grains of alloy of the same content of nickel-iron. At the end of the test, the amount of residue was 5.2%.

However, the Faraday yield of the anodic dissolution was near to 1.0; and, after 1300 Amp-hours, the ratio (total iron/iron+nickel) in the electrolyte was stable and almost 10%. The bath had then attained equilibrium.

At the end of the test, the amount of iron in the plating was 21.6%.

The quality of the cathodic plating was excellent.

EXAMPLE 2

The same shot as in Example 1 were tested in the same type of bath, but with an anodic current density of 3.8 Amps/dm$^2$ with a total anodic surface of 2 dm$^2$ for 432 hours, corresponding to a quantity of current of 3427 Amp-hours—as in Example 2 of the aforementioned patent application, Ser. No. 713,432. The amount of residue in the anode baskets was then 13%, and its chemical analysis showed the nickel/iron ratio to be substantially identical to that of the initial shot.

The Faraday anodic yield was near 1.0.

The Faraday cathodic yield was near 0.95.

The quality of the cathodic plating was excellent.

EXAMPLE 3

A fresh batch of shot was prepared from a bath of liquid alloy enriched with aluminum and magnesium.

The analysis of the shot was as follows:

Ni=77.05%
Co=0.5%
Mg=0.002%
Mn=0.013%
C=0.004%
Al=0.015%
Si=0.008%
Fe=remainder

These shots were then tested in the same type of bath as in the previous examples, under an anodic current density of 2.7 Amps/dm$^2$ for 132 hours (total quantity of current=1044 Amp-hours).

The amount of sediment collected in the anodic baskets was then 15.6%. However, the ratio (total iron/iron+nickel) was constant and near to 11%. The concentration of nickel+iron was near 33 g/l.

The quality of the cathodic coating was excellent.

EXAMPLE 4

Other shot were made from a molten bath of alloy enriched with silicon and manganese, as in Example 4 of the aforementioned patent application, Ser. No. 713,432.

The chemical analysis of these shot was as follows:

Ni+Co=73.6%
Mn=0.27%
Si=0.16%
C=0.020%
Fe=remainder

These shots were tested in the same type of bath as previously used under a current density of 2.5 Amps/dm$^2$ (total anodic surface 0.69 dm$^2$) for 375 hours (total of 645 Amp-hours).

The Faraday anodic yield was near 1.0, and the amount of residue formed was very low. This residue consisted of a blackish sediment containing silicon.

The manganese content in the bath rose from 0.003 g/l to 0.162 g/l at the end of the test.

In this example, a bath at equilibrium for an alloy of 77% Ni was fed with a 74% alloy, which involved an increase in the ratio (total iron/iron+nickel) in the bath of from 11 to 18%.

The concentration of nickel+iron in the bath remained practically constant at about 37 g/l.

The quality of the cathodic coating was excellent.

EXAMPLE 5

Another batch of shot was prepared from a molten bath enriched with silicon and carbon, as in Example 5 of the aforementioned patent application, Ser. No. 713,432.

The chemical analysis of the shot was:

Ni+Co=76.85%
Co=1.25%
Si=0.20%
C=0.17%
S=0.22%
Mn=0.05%
Fe=remainder

These shots were tested at an anodic current density of 2.4 Amps/dm$^2$ for 200 hours (total current of 942 Amp-hours).

The Faraday anodic yield was always near 1.0, and the amount of residue formed was not measurable.

There was no increase of silicon in the electrolyte.

The quality of the cathodic coating was excellent.

EXAMPLE 6

Another batch of shot was made from a molten bath of alloy enriched with silicon and carbon according to the technique already described in Examples 4 and 5.

The chemical analysis was as follows:

Ni=76%
Co=0.50%
Si=0.35%
C=0.10%

Mn=0.05%
Fe=remainder

A solubility test was carried out in a 100-liter tank in a bath having the following composition in g/l:

$NiSo_4 \cdot 6H_2O = 105$
$NiCl_2 \cdot 6H_2O = 60$
$FeSO_4 \cdot 7H_2O = 10$
$H_3BO_3 = 45$ Stabilizer for iron and organic products were employed as in Example 6 of the aforementioned patent application, Ser. No. 713,432.

The anodic current density was 3 Amps/dm$^2$, and the duration of the test was 330 hours corresponding to a current quantity of 5100 Amp-hours.

At the end of the test, the residue was only 0.2% with respect to the amount of shot consumed.

The quality of the cathodic coating was excellent.

The amount of sediment observed in Examples 2 and 3 was scarcely acceptable, for it represented a serious loss of starting material. However, beyond the fact that the sediment did not at all harm the electrolysis and the quality of the plating, Example 1 and other tests not described have shown the possibility of reducing the amount of sediment to levels entirely acceptable, by optimizing the operating conditions.

In particular, the use of higher current densities than 10 Amps/dm$^2$ permits reduction of such residue to acceptable levels. On the other hand, it should be noted that the residues from the baskets may be dissolved following the electro-deposition.

Although these examples relate essentially to ferro-nickel in which the amount of nickel is from about 74 to 77%, it will be clear to those skilled in the art that this teaching is applicable to ferro-nickels of various nickel contents (e.g., 20 to 90% by weight).

It will also be clear to those skilled in the art that the tolerance of impurities, such as has been shown by these tests and in the description, does not extend to any soluble metals of less reducing power than iron and nickel.

EXAMPLE 7

Another batch of shot, having the following chemical analysis, was prepared:

Ni=76.7%
Co=0.50%
Si=0.13%
C=0.02%
S=0.01%
Fe=remainder

A test was performed in an 80-liter tank containing the same electrolyte as in Example 6 (of pH 3.2) at a temperature of 62° C. using air agitation.

The test was performed continuously 24 hours a day for 2200 hours (3 months) using an anodic current density of 2.5 Amps/dm$^2$, which corresponded to a current quantity of 109,000 Amp-hours. In this time, the amount of nickel consumed corresponded to a fourfold renewal of the initial charge in the baskets.

The results were as follows:

Amount of sediment—0.9%, which is very good for such a test.

Fe III: Total Fe ratio between 12 and 20%.

EXAMPLE 8

Another test was performed in a 2500-liter tank using shot and electrolyte as in Example 7, at a pH of 3.2 and a temperature of 60° C., using mechanical agitation.

The test was carried out intermittently over the period December to July of the following year (8 months), with a current density which varied from 0.5 to 3 Amps/dm$^2$, corresponding to a total current quantity of about 500,000 Amp-hours.

The results were as follows:

Fe III: total Fe ratio between 2 and 9%

No problems were encountered (unlike in prior art techniques), and, after the charge in the anodic baskets had been consumed and renewed, there was still no need to wash the baskets or the anodic cells, which shows the undoubted advantages of the present invention.

EXAMPLE 9

Another test was performed in a 2000-liter tank using shot and electrolyte as in Example 7, at a pH of 3.2 and a temperature of 60° C., using agitation by air.

The test was carried out continuously for 24 hours a day for 2 months, using an anodic current density which varied from 0.5 to 3 Amps/dm$^2$, corresponding to a total current quantity of about 650,000 Amp-hours. In this time, the initial charge in the anodic baskets was completely renewed three times.

The sediment produced was negligible, and the Fe III: total Fe ratio was 19%.

EXAMPLES 10–34

Examples 10 to 27 were performed in the same way as in Examples 1 to 9, the duration of said tests being about 200 hours with a current density of about 5 a/dm$^2$ and in the same bath as the one used in Example 6.

The same shot samples were also tested in a bath with the same mineral components but with the following organic compounds:

| | |
|---|---|
| Sodium saccharinate | 5 g/l |
| Naphthalene trisulfonic 1.3.6 acid | 5 g/l |
| Ascorbic acid | 0.35 g/l |
| Sodium lauryl sulfate | 1 cm$^3$/l |

Anodic yield was about 100%. Cathodic yield was about 95%. The coating quality was identical to the coating obtained in the bath given in Example 6.

The tests of Examples 28–34 were performed under the same conditions as in the previous examples, but, due to the small size of the cell, the tests were only dissolution tests and not electroplating tests.

The results of Examples 10–36 are set forth in the following Table I:

TABLE I

| EXAMPLE NO. | ANALYSES OF THE SHOT wt % Ni | Co | Si | C | Mg | Mn | Al | S | SEDIMENT % |
|---|---|---|---|---|---|---|---|---|---|
| 10 | 76.5 | 0.48 | 0.05 to 0.07 | 0.0035 to 0.0157 | traces | traces* | 0.003 | 0.0110 | 6 to 7 |

TABLE I-continued

| EXAMPLE NO. | Ni | Co | Si | C | Mg | Mn | Al | S | SEDIMENT % |
|---|---|---|---|---|---|---|---|---|---|
| | | | | ANALYSES OF THE SHOT wt % | | | | | |
| 11 | 76.6 | 0.50 | 0.12 to 0.22 | 0.0035 to 0.0157 | traces | traces | 0.003 | 0.0110 | 5.4 |
| 12 | 75 to 76 | 0.50 | 0.10 to 0.60 | 0.0035 to 0.0157 | traces | traces | 0.003 | 0.0110 | 3.5 to 7 |
| 13 | 76 to 77 | 0.55 | 0.05 to 0.20 | 0.005 to <0.020 | traces | <0.05 | 0.002 | 0.0100 to 0.0120 | 2.5 to 5 |
| 14 | 76.5 | 0.49 | 0.38 | 0.11 | traces | <0.05 | traces | 0.0110 | 5 |
| 15 | 76.5 | 0.49 | 0.06 | traces | traces | traces | 0.5 | 0.0100 | 6 to 7 |
| 15 bis | 76.3 | 0.47 | 0.32 | 0.025 | traces | traces | traces | 0.0120 | 2.1 |
| 16 | 75 | 0.48 | ≦0.05 | traces | 0.05 | <0.05 | traces | 0.0100 | 1.3 |
| 17 | 75.4 | 0.46 | ≦0.05 | traces | 0.08 | <0.05 | traces | 0.0100 | 1.1 |
| 17 bis | 75.6 | 0.48 | ≦0.05 | traces | 0.006 | 0.090 | traces | 0.0110 | 1.1 |
| 18 | 75 | 0.48 | 0.05 | 0.29 | 0.07 | <0.05 | traces | 0.0100 | 1.2 |
| 19 | 75.5 | 0.45 | 0.05 | 0.11 | 0.07 | <0.05 | traces | 0.0100 | 0.9 |
| 20 | 74.8 | 0.47 | 0.05 | 0.07 | 0.08 | <0.05 | traces | 0.0100 | 0.7 |
| 21 | 74.6 | 0.44 | 0.05 | traces | 0.08 | 0.06 | traces | 0.0100 | 0.3 |
| ** 22 | 74.8 | 0.44 | <0.05 | traces | 0.01 to 0.25 | 0.05 to 0.20 | traces | 0.0100 | 0.7 |
| 23 | 74.2 | 0.46 | at most equal to 0.05 | traces | 0.1 | 0.07 | traces | 0.0100 | 0.3 |
| 24 | 75.2 | 0.48 | 0.05 | 0.04 | 0.08 | at most equal to 0.01 | at most equal to 0.01 | 0.0100 | <0.2 |
| 25 | 74.8 | 0.43 | ≦0.05 | traces | 0.225 | 0.10 | traces | 0.0110 | 0.7 |
| 26 | 74.8 | 0.42 | <0.05 | traces | 0.42 | 0.20 | traces | 0.0100 | 0.7 |
| 27 | 59.7 | 0.57 | 0.14 | 0.036 | 0.067 | 0.0062 | 0.026 | 0.0150 | less than 1 |
| 28 | 59.7 | 0.55 | 0.070 | 0.30 | 0.060 | 0.0062 | traces | 0.0150 | 7 |
| 29 | 59.5 | 0.5 | 0.14 | 0.018 | 0.050 | at most 0.01 | 0.029 | 0.0170 | 0,72 |
| 30 | 59.8 | 0.54 | 0.15 | 0.023 | 0.060 | at most 0.01 | traces | 0.0210 | 0.26 |
| 31 | 59.7 | 0.56 | 0.16 | 0.021 | 0.068 | at most 0.01 | 0.025 | 0.0190 | 0.12 |
| 32 | 60 | 0.45 | 0.09 | 0.104 | 0.030 | at most 0.01 | 0.030 | 0.0120 | 0.2 |
| 33 | 28.2 | 0.78 | 0.060 | 0.011 | traces | 0.017 | 0.040 | 0.0210 | 0.5 |
| 34 | 24.6 | 0.75 | 0.03 | <0.002 | traces | 0.19 | 0.01 | 0.0130 | <1 |

*traces amount to less than 0.001%.

**this example corresponds to an average value of several tests; in this example, the granule position varies in such a way that the sum of Mg and Mn is between 0.2 and 0.3%.

EXAMPLE 35

The afore-described new compression test was carried out on the shot of Examples 11, 15, 19, 24, 28, 29, 32, and 34 using INSTRON Model T.T.D.M. as the compression machine at a speed of 5 mm/minute and a load ranging from 0 to 10000 kg (0–10 metric tons).

In the lot of shots tested, the shot size preferably ranged between 10 and 15 mm.

The shot was compressed following the largest diameter direction. Two parallel flat areas of about 15 $mm^2$ were made by abrasion so that the stability of the shot between the two plates was ensured. The load was applied on the upper plate.

The above-described test allows one to obtain the shot deformation value Δe ("e" for "epaisseur", i.e., thickness) as a function of the applied load in the form of a diagram. It also enables one to measure the load necessary for splitting and the load necessary for the appearance of the first fissuration.

The results are shown in the following Table II.

TABLE II

| Shot of example | Sediment ratio (%) | First fissuration load (in metric ton) | Splitting load (in metric ton) |
|---|---|---|---|
| 11 | 5 | 1 | 3 |
| 15 | 7 | 0.5 | 0.5 |
| 19 | 0.9 | 0.5 to 0.7 | >5 |
| 24 | 0.2 | 2 | >5 |
| 28 | 0.9 to 1 | 1.5 | >5 |
| 29 | 7.3 | 0.9 | 1.2 |
| 32 | 0.26 | 3 | >5 |
| 34 | 0.20 | 4 | >5 |

As is apparent from the above, this test is a very reliable way to predict the sediment ratio.

The Brighteners FN 1, FN 2, and 84, Stabilizer NF, and Wetting Agent 62A, utilized in Examples 1 and 6 are products of The Udylite Company of Detroit, Michigan, a Division of Oxy Metal Finishing Corporation, and are conventionally used in electrolytic baths. These functions are described in The Udylite Technical Bulletin, issued September 17, 1973. The inventors have been advised by Officials of The Udylite Company that the compositions used in the examples correspond to the composition range described on page 8 of British Pat.

No. 1,438,554, and that every brightener and stabilizer is also disclosed in this British patent.

EXAMPLE 26

Comparative experiments were conducted in a bath whose initial composition was the following:

| | | |
|---|---|---|
| $NiSO_4\ 6H_2O$ | 200 g/l | $\frac{SO_4}{Cl} = 3.69$ |
| $NiCl_2\ 6H_2O$ | 70 g/l | |
| $FeSO_4\ 7H_2O$ | 11 g/l | |
| $H_3BO_3$ | 45 g/l | |
| Stabilizer | 20 g/l | |
| Brighteners | | |
| 1 | 25 cc/l | |
| 2 | 2.5 cc/l | |
| 3 | 18 cc/l | |
| Wetting agent | 1 cc/l | |
| pH = 3.5 | | |

Two 80 liter vats filled with the same initial bath, one with 4 titanium baskets filled with shot (vat A) and having a surface of 6.66 $dm^2$ and the other vat, B, with three baskets filled with nickel (S=5 $dm^2$) and another filled with iron (S=1.66 $dm^2$) were gone over by the same current totalling 50 A (vats A and B in sequence), i.e., an average density of anodic current of 3 $A/dm^2$. The cathodic deposits were obtained with a current density of 5 $A/dm^2$ under agitation with the air in the two vats being identical. The experiments lasted about 300 hours. The temperature was near 60° C. We voluntarily permitted the evolution of the metal concentration of the 2 baths.

The anodic manic yield in the case of vat A is almost 100% while that of vat B is higher than 100% (about 103%) showing a chemical dissolving of about 400 g of iron out of the 2,360 g of iron passed in solution.

The cathodic yield of the deposit in vat A is slightly higher than that of vat B and approaches 94%.

At the end of the experiments the average composition of the yield was close to that of the shot in the case of vat A (Ni 73%−Fe 27%) while that of the deposits obtained in vat B was close to 82% Ni and 17% Fe.

The concentration of Ni+Fe of vat B was on the order of 87 g/l while that of vat B was on the order of 80 g/l (an error in the regulation of the level of vat B resulted in a dilution of the bath limiting the gaps observed in the end of the experiments).

The Ni concentration of vat B was on the order of 83.5 g/l at the end of the experiments while that of vat A was close to 75 g/l.

The ratio total Fe/Ni+Fe after 2500 Amp-hr was 6±0.5% in vat A while that of vat B was 3.5±0.5%. During the experiments the ratio Fe+++/Fe Total of vat A was lower than 20% and close to 10%±2.5% after 10,000 Amp-hr and up to the end of the experiments, while for vat B it was 38% after 2,500 Amp-hr, returning to the neighborhood of 20% with fluctuations of plus or minus 7.5%. The consumption of total acid used to maintain the pH of the bath constant during the duration of the experiments was markedly the same in the two vats, taking into account the precision of the measurements. The measure of the density of the two baths of vats A and B showed a more rapid increase in the density of vat B (1206 for vat A and 1212 for vat B after 9,000 Amp-hr while the density of the initial bath for the two vats was 1170) which confirms the increase in the Ni concentration in a more important manner in the case of vat B.

Other comparative experiments carried out in conditions similar to those described above have shown that, in order to maintain the density of the bath constant, it was necessary to make removals from the bath more frequently in the type B vat (removal of about 2 l. of solution out of 80 liters of bath and replacement by about 2 l. of water);

vat with separated anodes ~4 to 5 removals/10,000 Amp-hr vat with shot anodes ~2 to 3 removals/10,000 Amp-hr The above examples show the advantage of using shot to facilitate the use of the bath and to obtain deposits of the desired composition.

These examples also show the difficulty of determining the good relationship between the anodic surface of the Ni baskets and the Iron baskets in the case of separated anodes.

We claim:

1. A process of electro-depositing a layer of a ferronickel alloy from an electrolytic bath comprising using, as the anode therein, a soluble anode consisting of an anodic basket filled with ferro-nickel shot, having a Ni/(Ni+Fe) ratio ranging from about 20 to 90% by weight, and containing between 0.1 and 1% by weight of at least one granulating adjuvant selected from the group consisting of silicon, carbon, manganese, magnesium and aluminium, said shot having been prepared by a water granulating process and being of a composition substantially identical to that of the layer to be deposited.

2. The process of claim 1 wherein the ferronickel shot are derived from a cast alloy to which a granulating adjuvant containing silicon had been added.

3. The process of claim 1 wherein the ferronickel shot are derived from a cast alloy to which a granulating adjuvant containing carbon had been added.

4. The process of claim 1 wherein the ferronickel shot are derived from a cast alloy to which a granulating adjuvant containing manganese had been added.

5. The process of claim 1 wherein the ferronickel shot are derived from a cast alloy to which a granulating adjuvant containing aluminum had been added.

6. The process of claim 1 wherein the ferronickel shot are derived from a cast alloy to which a granulating adjuvant containing magnesium had been added.

7. The process of claim 1 wherein the shot contains about from 73% to 77% of nickel and about from 21% to 26% of iron.

8. The process of claim 1 wherein the electrolytic bath has the following composition in the recited proportions:

| | |
|---|---|
| $NiSO_4 . 6H_2O$ | 75–200 g/l |
| $NiCl_2 . 6H_2O$ | 60–75 g/l |
| $FeSO_4 . 7H_2O$ | 10 g/l |
| $H_3BO_3$ | 45 g/l |
| Brighteners | 45.5 cc/l |
| Iron stabilizer | 25 g/l |
| Wetting agent | 1 cc/l |

9. The process of claim 1 wherein the ratio of ferric iron to the total amount of iron in the electrolytic bath does not exceed about 40%.

10. The process of claim 9 wherein the ratio of ferric iron to the total amount of iron in the electrolytic bath does not exceed about 20%.

11. The process of claim 1 wherein the electrolysis is carried out using an anodic current density of from about 0.5 to 10 amps/dm$^2$, at a pH of from about 3 to 4, at a temperature of from about 55° C. to 65° C.

12. The process of claim 1 wherein the electrolytic bath contains about from 10 to 40 g/l of chloride ions, with the sulfate:chloride ratio being between 2.5 and 4.

13. The process of claim 1 wherein the ferro-nickel shot has a columnar or equiaxed structure without dendritic substructures.

14. The process of claim 1 wherein the ferro-nickel shot does not disintegrate when its larger diameter is decreased by 1/3 when compressed in a hand-vise.

15. The process of claim 1 wherein the ferro-nickel shot is not disintegrated under a load of 5 tons when compressed in a compression device.

16. The process of claim 1 wherein the first fissuration appears in the ferro-nickel shot at a compression value higher than 2 tons when compressed in a compression device.

17. The process of claim 1 wherein the ferro-nickel shot contains between 0.1 and 0.5% of silicon.

18. The process of claim 1 wherein the ferro-nickel shot contains silicon, carbon, magnesium, manganese and aluminium in the following ranges:

Silicon: 0.02 to 0.50%
Carbon: 0.03 to 0.20%
Magnesium: 0.02 to 0.40%
Manganese: 0.01 to 0.10%
Aluminum: 0.01 to 0.10%

19. The process of claim 18 wherein the ferro-nickel shot contains silicon, carbon, magnesium, manganese and aluminum in the following ranges:

Silicon: 0.04 to 0.20%
Carbon: 0.03 to 0.10%
Magnesium: 0.04 to 0.10%
Manganese: 0.02 to 0.10%
Aluminum: 0.01 to 0.06%

20. The process of claim 19 wherein the sum of all adjuvants added is between 0.2 and 0.3%.

21. The process of claim 19 wherein the sum of magnesium+manganese+aluminium is between 0.07 and 0.2%.

22. The process of claim 19 wherein the ferro-nickel shot contains other than the adjuvants under 0.2% of impurities.

23. The process of claim 19 wherein the ferro-nickel shot contains less than 0.03% of copper.

24. The process of claim 19 wherein the ferro-nickel shot contains less than 0.02% of sulphur.

25. The process of claim 1 wherein the ferro-nickel shot has a ratio of Ni/(Ni+Fe) ranging between 70 to 80% by weight and contains silicon, carbon, magnesium, manganese and aluminum in the following ranges:

Silicon: 0.04 to 0.10%
Carbon: 0.03 to 0.05%
Magnesium: 0.05 to 0.08%
Manganese: traces
Aluminum: traces 26. The process of claim 25 wherein the sum of all adjuvants added is between 0.2 and 0.3%.

27. The process of claim 1 wherein the ferro-nickel shot has a ratio of Ni/(Ni+Fe) ranging between 50 to 69% by weight and contains silicon, carbon, magnesium, manganese and aluminum in the following ranges:

Silicon: 0.10 to 0.20%
Carbon: 0.03 to 0.10%
Magnesium: 0.03 to 0.08%
Manganese: 0.01 to 0.07%
Aluminum: 0.02 to 0.06%

28. The process of claim 27 wherein the sum of all adjuvants added is between 0.2 and 0.3%.

29. The process of claim 27 wherein the sum of magnesium+manganese+aluminum is between 0.07 and 0.2%.

* * * * *